US008017569B2

(12) United States Patent
DeDominicis et al.

(10) Patent No.: US 8,017,569 B2
(45) Date of Patent: Sep. 13, 2011

(54) HOB CLEANING COMPOSITION

(75) Inventors: Mattia DeDominicis, Johannesburg (ZA); Jennifer Duran, Hull (GB)

(73) Assignee: Reckitt Benckiser Inc., Parsippany, NJ (US)

( * ) Notice: Subject to any disclaimer, the term of this patent is extended or adjusted under 35 U.S.C. 154(b) by 0 days.

(21) Appl. No.: 12/745,333

(22) PCT Filed: Nov. 14, 2008

(86) PCT No.: PCT/GB2008/003832

§ 371 (c)(1),
(2), (4) Date: Oct. 25, 2010

(87) PCT Pub. No.: WO2009/074766

PCT Pub. Date: Jun. 18, 2009

(65) Prior Publication Data

US 2011/0039748 A1 Feb. 17, 2011

Related U.S. Application Data

(60) Provisional application No. 61/012,584, filed on Dec. 10, 2007.

(51) Int. Cl.
*C11D 1/38* (2006.01)

(52) U.S. Cl. ..... 510/181; 510/421; 510/504; 510/506

(58) Field of Classification Search ..... 510/506, 510/504, 421, 426, 428, 424, 189, 181
See application file for complete search history.

(56) References Cited

U.S. PATENT DOCUMENTS

| | | | | | |
|---|---|---|---|---|---|
| 4,806,260 | A * | 2/1989 | Broze et al. | ..... | 510/304 |
| 5,871,590 | A * | 2/1999 | Hei et al. | ..... | 134/26 |
| 5,962,388 | A * | 10/1999 | Sherry et al. | ..... | 510/238 |
| 6,087,309 | A * | 7/2000 | Vinson et al. | ..... | 510/125 |
| 6,239,093 | B1 * | 5/2001 | Foley et al. | ..... | 510/352 |
| 6,479,446 | B1 * | 11/2002 | Sherry et al. | ..... | 510/238 |
| 6,949,496 | B1 * | 9/2005 | Boutique et al. | ..... | 510/276 |
| 7,745,384 | B2 * | 6/2010 | Perry et al. | ..... | 510/253 |
| 2002/0173438 | A1 * | 11/2002 | Levitt et al. | ..... | 510/189 |
| 2003/0064910 | A1 * | 4/2003 | Fong et al. | ..... | 510/421 |
| 2008/0139443 | A1 * | 6/2008 | Buzinski et al. | ..... | 510/362 |
| 2011/0039748 | A1 * | 2/2011 | DeDominicis et al. | ..... | 510/181 |

FOREIGN PATENT DOCUMENTS

| | | | |
|---|---|---|---|
| DE | 10045289 | A1 | 3/2002 |
| GB | 2334723 | A | 9/1999 |
| WO | 9208823 | A | 5/1992 |
| WO | 9743365 | A | 11/1997 |
| WO | 2005113735 | A | 12/2005 |

OTHER PUBLICATIONS

English Language Abstract for DE10045289 taken from esp@cenet.com, Mar. 28, 2002.

* cited by examiner

*Primary Examiner* — Gregory Webb
(74) *Attorney, Agent, or Firm* — Norris McLaughlin & Marcus, P.A.

(57) ABSTRACT

Hard surface cleaning composition particularly suited for the cleaning of kitchen or cooking stove having a cooktop which includes a glass plate which is effective in the cleaning treatment of stained glass plates, and which is especially effective in the treatment of dried or baked on milk stains.

9 Claims, No Drawings

HOB CLEANING COMPOSITION

This is an application filed under 35 USC 371 of PCT/GB2008/003832.

The present invention relates to improved hard surface cleaning compositions which are particularly useful in the cleaning treatment of nonporous surfaces. More particularly the present invention is related to improved hard surface cleaning compositions which are particularly suited for the cleaning of glass, ceramic or vitreous surfaces, and especially glass stovetops which are subjected to elevated temperatures.

In the past decade, the popularity of kitchen and cooking stoves which provide heat to cooking vessels, e.g., pots and pans, through a glass surface has dramatically increased. As opposed to stoves which provide heat to such cooking vessels via either one or more flame manifolds which burn a gas such as propane or natural gas, or via direct contact with an electrical resistance element or coil, stoves with glass surfaces offer a number of technical advantages. First of these are the fact that the glass surfaces are essentially a continuous flat plate which is far easier to clean than stoves with flame manifolds or electrical resistance coils. Any spillage of foodstuffs or other materials onto a continuous flat plate is typically far easier to contain and to subsequently clean than stoves with flame manifolds or electrical resistance coils. The construction of such latter stoves with flame manifolds or electrical resistance coils typically require a number of discrete parts or elements, such as dishes or trays beneath the flame manifolds or electrical resistance coils in order to catch and retain spilled materials and foodstuffs, as well as necessary piping, tubing or electrical connectors and conductors as are suitably required for the flame manifolds or electrical resistance coils which may be present. Additional elements, such as trim rings surrounding such dishes or trays, as well as support grates which are commonly provided to support cooking vessels above a flame manifold are also commonly provided. Each of such elements, while useful or necessary in providing either an aesthetic function or a utilitarian function invariably also present additional surfaces which require periodic cleaning. Such is inconvenient, and has led to the popularity of kitchen and cooking stoves which provide heat to cooking vessels through a glass surface which are by comparison far easier to clean and maintain. Such are known to the art, and typically are a glass plate which is mounted in a generally horizontal manner on a suitable supporting surface (e.g., countertop) or article (e.g., stove, range, or other appliance) beneath which are provided one or more electrically operated elements which radiate electromagnetic energy, typically heat or in some cases, magnetic energy, through the glass plate upon which are positioned cooking vessels. The electromagnetic energy is absorbed by the cooking vessel which is heated thereby and which is used to prepare foodstuffs. Typically, one or more electrically operated elements have a cross sectional area or surface which placed in close proximity to parts of the underside of the glass plate, and the region of the glass plate through which the electromagnetic energy is radiated is commonly referred to as a "hob". Usually, the area of the "hob" is marked or otherwise identified on the top surface of the glass plate in order to provide an indicator to a consumer as to the correct placement of a cooking vessel so to be above an electrically operated element positioned beneath the glass plate. In such a manner the most effective radiation of electromagnetic energy from an element through a portion of a glass plate, viz., "hob" to a cooking vessel may be realized. Conventionally such glass plates used in kitchen and cooking stoves have one or more electrically operated elements positioned beneath the glass plate, and thus have one or more corresponding hobs.

Frequently the electrically operated elements are resistance elements whose temperature rise upon the application of suitable current across their terminals, and elevated temperatures in excess of 100° C., more frequently in excess of 150° C. are encountered. Unhelpfully such elevated temperatures imparted to the glass surfaces, particularly within or near the region of the hobs also heats any materials present thereon, such as spilled foodstuffs. Such exposure to elevated temperatures often leads to baking or even charring of spilled foodstuffs which may provide malodours and unsightly deposits and stains. One of the most difficult to remove foodstuffs which has been subjected to such elevated temperatures on such a glass surface is milk. Many presently available hard surface cleaning compositions fare poorly in the removal of dried or baked on milk stains, such as may be found at or proximate to the hobs of a kitchen or cooking stove having a cooktop which includes a glass plate.

The present invention provides, in one aspect, a hard surface cleaning composition particularly suited for the cleaning of kitchen or cooking stove having a cooktop which includes a glass plate which is effective in the cleaning treatment of stained glass plates, and which is especially effective in the treatment of dried or baked on milk stains.

In a further aspect the present invention provides a method of producing a hard surface cleaning composition particularly suited for the cleaning of kitchen or cooking stove having a cooktop which includes a glass plate which is effective in the cleaning treatment of stained glass plates, and which is especially effective in the treatment of dried or baked on milk stains.

In a still further aspect the present invention relates to a process for the cleaning treatment of a stained glass cooktop of a kitchen or cooking stove, particularly wherein the stains are dried or baked on said cooktop, and especially particularly wherein the dried or baked on stains are milk stains.

These and other aspects of the invention will be apparent from the following specification.

The compositions of the invention advantageously, and in preferred embodiments, necessarily, comprise a surfactant constituent which is a blend of ethoxylated quaternary amine based surfactants with nonionic alcohol ethoxylate surfactants wherein the latter contain 9 to about 11 carbon atoms with about 3 to about 6 mols ethoxylation, preferably in a respective weight ratio of at least 1:1.

The compositions necessarily include at least one nonionic surfactant.

One class of exemplary useful nonionic surfactants are polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

Further useful nonionic surfactants include the condensation products of aliphatic alcohols with from about 1 to about 60 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5 (also available as Teric G9A5), which is described in product literature from Sasol as a $C_{8-10}$ having an average molecular weight of 356, an ethylene oxide content of about 4.85 moles (about 60 wt. %), and an HLB of about 12; Alfonic® 810-2, which is described in product literature from Sasol as a $C_{8-10}$ having an average molecular weight of 242, an ethylene oxide content of about 2.1 moles (about 40 wt. %), and an HLB of about 12; and Alfonic® 610-3.5, which is described in product literature from Sasol as having an average molecular weight of 276, an ethylene oxide content of about 3.1 moles (about 50 wt. %), and an HLB of 10. Product literature from Sasol also identifies that the numbers in the alcohol ethoxylate name designate the carbon chain length (numbers before the hyphen) and the average moles of ethylene oxide (numbers after the hyphen) in the product.

Further exemplary useful nonionic surfactants include alcohol ethoxylates which are described as $C_9$-$C_{11}$ ethoxylated alcohols and marketed under the Neodol® tradename. The Neodol® 91 series non-ionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Still further examples of ethoxylated alcohols include the Rhodasurf® DA series non-ionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630.

Further examples of useful nonionic surfactants include alcohol ethoxylates including C10 oxo-alcohol ethoxylates available from BASF under the Lutensol ON tradename. They are available in grades containing from about 3 to about 11 moles of ethylene oxide (available under the names Lutensol ON 30; Lutensol ON 50; Lutensol ON 60; Lutensol ON 65; Lutensol ON 66; Lutensol ON 70; Lutensol ON 80; and Lutensol ON 110).

Yet further examples of ethoxylated alcohols include those from Tomah Products (Milton, Wis.) under the Tomadol tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear C9/C10/C11 and n is 2.5, 6, or 8; 1-3; 1-5; 1-7; 1-73B; 1-9;—where R is linear C11 and n is 3, 5, 7 or 9; 23-1; 23-3; 23-5; 23-6.5—where R is linear C12/C13 and n is 1, 3, 5, or 6.5; 25-3; 25-7; 25-9; 25-12—where R is linear C12/C13 C14/C15 and n is 3, 7, 9, or 12; and 45-7; 45-13—where R is linear C14/C15 and n is 7 or 13.

Preferably the compositions of the invention comprise at least one nonionic surfactant based on alkoxylated alcohols, preferably ethoxylated alcohols.

Other examples of useful nonionic surfactants include those having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename. available from Clariant, Charlotte, N.C., include the 26-L series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N. From product literature, the single number following the "L" corresponds to the average degree of ethoxylation (numbers between 1 and 5) and the two digit number following the letter "L" corresponds to the cloud point in ° C. of a 1.0 wt. % solution in water.

A specific class of useful nonionic surfactants include are monobranched alkoxylated C10-fatty alcohols and/or C11-fatty alcohols; these are jointly referred to as C10/C11-fatty alcohols. These materials are nonionic surfactants are monobranched and may have various degrees of alkoxylation, and are typically ethoxylated with between about 3 and 14 moles of ethylene oxide, typically 4, 5, 6, 7, 8, 9, 10 or 14 moles ethylene oxide. Such nonionic surfactants are presently commercially available under the Lutensol® (ex. BASF AG) and are available in a variety of grades e.g., Lutensol® XL 40 recited by its supplier to be a C10-Guerbet alcohol which is approximately 4 moles of ethoxylation, Lutensol® XL 50 recited by its supplier to be a C10-Guerbet alcohol which is approximately 5 moles of ethoxylation, Lutensol® XL 60 recited by its supplier to be a C10-Guerbet alcohol which is approximately 6 moles of ethoxylation, Lutensol® XL 70 recited by its supplier to be a C10-Guerbet alcohol which is approximately 7 moles of ethoxylation, Lutensol® XL 40 recited by its supplier to be a C10-Guerbet alcohol which is approximately 4 moles of ethoxylation, Lutensol® XL 79 recited by its supplier to be a C10-Guerbet alcohol which is approximately 7 moles of ethoxylation, Lutensol® XL 80 recited by its supplier to be a C10-Guerbet alcohol which is approximately 8 moles of ethoxylation, Lutensol® XL 89 recited by its supplier to be a C10-Guerbet alcohol which is approximately 8 moles of ethoxylation, Lutensol® XL 90 recited by its supplier to be a C10-Guerbet alcohol which is approximately 9 moles of ethoxylation, Lutensol® XL 99 recited by its supplier to be a C10-Guerbet alcohol which is approximately 9 moles of ethoxylation, Lutensol® XL 100 recited by its supplier to be a C10-Guerbet alcohol which is approximately 10 moles of ethoxylation, Lutensol® XL 140 recited by its supplier to be a C10-Guerbet alcohol which is approximately 14 moles of ethoxylation, all available from BASF AG. Alternately or additionally, nonionic surfactant based on monobranched alkoxylated C10-fatty alcohols marketed under the Lutensol® XP series of surfactants, also ex. BASF AG, may also be used. While the foregoing materials are ethoxylated, it is to be understood that other alkoxylated, e.g., propoxylated, butoxylated, as well as mixed ethoxylated and propoxylated branched nonionic alkyl polyethylene glycol ether may also be used.

It is contemplated by the inventors that similar nonionic surfactants based on monobranched alkoxylated C11-fatty alcohols may be used to substitute part of, or all of the nonionic surfactant based on monobranched alkoxylated C10-fatty alcohols. These include for example, the Genapol® UD series described as tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO (ex. Clariant).

A further class of nonionic surfactants which are contemplated to be useful include those based on alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y(EO)_z\text{—}H \quad (A)$$

where EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC tradename from BASF or Emulgen from Kao.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO\text{—}(BO)_n(EO)_x\text{—}H \quad (C)$$

wherein R is an alkyl group containing I to 20 carbon atoms, n is about 5-15 and x is about 5-15.

Also useful as the nonionic block copolymer surfactants, which also include polymeric butoxy groups, are those which may be represented by the following formula (D):

$$HO\text{-}(EO)_x(BO)_n(EO)_y\text{—}H \quad (D)$$

wherein n is about 5-15, preferably about 15, x is about 5-15, preferably about 15, and y is about 5-15, preferably about 15.

Still further useful nonionic block copolymer surfactants include ethoxylated derivatives of propoxylated ethylene diamine, which may be represented by the following formula:

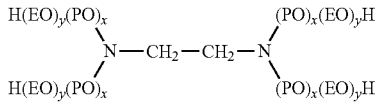

(E)

where(EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Surfactants based on amine oxides are also contemplated to be possibly useful in the present inventive compositions. Exemplary amine oxides include:

alkyl di($C_1$-$C_7$) amine oxides in which the alkyl group has about 10-20, and preferably 12-16 carbon atoms, and can be straight or branched chain, saturated or unsaturated. Examples of such compounds include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

alkyl di(hydroxy $C_1$-$C_7$) amine oxides in which the alkyl group has about 10-20, and preferably 12-16 carbon atoms, and can be straight or branched chain, saturated or unsaturated. Examples of such compounds include bis(2-hydroxyethyl) cocoamine oxide, bis(2-hydroxyethyl) tallowamine oxide; and bis(2-hydroxyethyl) stearylamine oxide;

alkylamidopropyl di($C_1$-$C_7$) amine oxides in which the alkyl group has about 10-20, and preferably 12-16 carbon atoms, and can be straight or branched chain, saturated or unsaturated. Examples of such compounds include cocoamidopropyl dimethyl amine oxide and tallowamidopropyl dimethyl amine oxide; and alkylmorpholine oxides in which the alkyl group has about 10-20, and preferably 12-16 carbon atoms, and can be straight or branched chain, saturated or unsaturated.

In certain preferred embodiments the inventive compositions include an alkyl amine oxide based on coconut or alkyl di-(lower alkyl) amine oxides, specific, albeit non-limiting examples of which include dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide, 3-dodecoxy-2-hydroxypropyldi-(2-hydroxyethyl)amine oxide, isoalkyl dimethyl amine oxide, stearyl dimethyl amine oxide, and octyl dimethyl amine oxide, dimethyl-alkylamidopropyl amine oxide, dimethyl amine oxides, such as decyl dimethyl amine oxide, lauryl dimethyl amine oxide, myristyl dimethyl amine oxide, cetyl dimethyl amine oxide, combinations thereof, and the like.

In preferred embodiments the compositions of the invention necessarily include a nonionic surfactant which is a low molecular weight nonionic surfactant. Although not limiting to the present invention, it is believed that such nonionics more quickly penetrate hydrophobic soil. Suitable nonionics include ethoxylates of alcohols of about 9 to about 11 carbon atoms with about 3 to about 6 ethoxylates. Additional suitable nonionics include $C_6$-$C_{14}$ alcohol ethoxylates having 1 to about 8 ethylene oxide groups; $C_6$-$C_{14}$ alkylphenol ethoxylates, preferably $C_8$-$C_{10}$ alkylphenol ethoxylates, having 1 to about 8 ethylene oxide groups or about 12 to about 20 ethylene oxide groups; $C_6$-$C_{14}$ fatty acid ester ethoxylates, propoxylates or glycerides, and dialkylamine ethoxylates or propoxylates. n an embodiment, the nonionic surfactant includes a low molecular weight nonionic surfactant. Although not limiting to the present invention, it is believed that such nonionics more quickly penetrate hydrophobic soil. Of these, preferred nonionic surfactants for the method of the invention include one or more ethoxylates of alcohols of 9 to 11 carbon atoms and with about 4 ethoxylates or less.

While the nonionic surfactant, when present, may be present in any effective amount, advantageously the inventive compositions comprise from 0.1-5% wt. of a nonionic surfactant constituent. When a nonionic surfactant constituent is present, preferably it includes, but more preferably consists of an alcohol ethoxylate nonionic surfactant.

The compositions of the invention may include one or more further cosurfactants based on anionic, cationic, amphoteric or zwitterionic surfactants.

Exemplary anionic surfactants alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof. These anionic surfactants may be provided as salts with one or more organic counterions, e.g, ammonium, or inorganic counteraions, especially as salts of one or more alkaline earth or alkaline earth metals, e.g, sodium.

Further examples of anionic surfactants include water soluble salts or acids of the formula $(ROSO_3)_xM$ or $(RSO_3)_xM$ wherein R is preferably a $C_6$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a mono-, di- or tri-valent cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like) and x is an integer, preferably 1 to 3, most preferably 1. Materials sold under the Hostapur and Biosoft trademarks are examples of such anionic surfactants.

Still further examples of anionic surfactants include alkyl-diphenyl-ethersulphonates and alkyl-carboxylates.

Also useful as anionic surfactants are diphenyl disulfonates, and salt forms thereof, such as a sodium salt of diphenyl disulfonate commercially available as Dowfax® 3B2. Such diphenyl disulfonates are included in certain preferred embodiments of the invention in that they provide not only a useful cleaning benefit but concurrently also provide a useful degree of hydrotropic functionality.

Other anionic surfactants can include salts (including, for example, sodium, potassium, ammonium, and substituted ammonium salts such as mono-, di- and triethanolamine salts) of soap, $C_6$-$C_{20}$ linear alkylbenzenesulfonates, $C_6$-$C_{22}$ primary or secondary alkanesulfonates, $C_6$-$C_{24}$ olefinsulfonates, sulfonated polycarboxylic acids prepared by sulfonation of the pyrolyzed product of alkaline earth metal citrates, $C_6$-$C_{24}$ alkylpolyglycolethersulfates, alkyl ester sulfates such as $C_{14-16}$ methyl ester sulfates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Examples of the foregoing anionic surfactants are available under the following tradenames: Rhodapon®, Stepanol®, Hostapur®, Surfine®, Sandopan®, Neodox®, Biosoft®, and Avanel®.

An anionic surfactant compound which may be particularly useful in the inventive compositions when the compositions are at a pH of 2 or less are one or more anionic surfactants based on alphasulphoesters including one or more salts thereof. Such particularly preferred anionic surfactants may be represented by the following general structures:

(A)

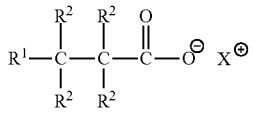

(B)

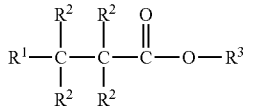

wherein, in each of the foregoing:

$R^1$ represents a $C_6$-$C_{22}$ alkyl or alkenyl group;

each of $R^2$ is either hydrogen, or if not hydrogen is a $SO_3^-$ having associated with it a cation, $X^+$, which renders the compound water soluble or water dispersible, with X preferably being an alkali metal or alkaline earth metal especially sodium or potassium, especially sodium, with the proviso that at least one $R^2$, preferably at least two $R^2$ is a $(SO_3^-)$ having an associated cation $X^+$, and, $R^3$ represents a $C_1$-$C_6$, preferably $C_1$-$C_4$ lower alkyl or alkenyl group, especially methyl.

According to certain preferred embodiments, anionic surfactants are however expressly excluded from the compositions of the present invention.

Exemplary cationic surfactant compositions are those which provide a germicidal effect to the compositions, and especially preferred are quaternary ammonium compounds and salts thereof, which may be characterized by the general structural formula:

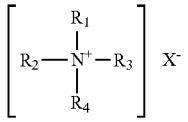

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Further exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

In certain preferred embodiments, the inventive composition necessarily include a quaternary ammonium compound which includes alkyl ethoxylated and/or propoxylated quaternary ammonium salts (or amines). Preferably, the alkyl group of such compounds contains between about 6 and about 22 carbon atoms and can be saturated and/or unsaturated. The degree of ethoxylation is preferably between about 2 and about 20, and/or the degree of propoxylation is preferably between about 0 and about 30. In an embodiment, the quaternary ammonium compound includes an alkyl group with about 6 to about 22 carbon atoms and a degree of ethoxylation between about 2 and about 20. A preferred cationic surfactant is commercially available under the name Berol ENV 266 (ex. Akzo-Nobel) which is indicated by its supplier to be an aqueous surfactant blend which includes 10-24% wt. of a chloride salt of a quaternary coco alkyl methyl amine ethoxylate; 30-50% wt. $C_9$-$C_{11}$ ethoxylated alcohol, avg. 4-5.5 degree of ethoxylation; and, 30-50% wt. water. Compositions of the invention which include such a material are observed to have excellent cleaning characteristics.

A further surfactant blend which has also been observed to be particularly useful in compositions of the invention include those available under the tradename Videt Q3 (ex. Vitech International Inc.) which is described to be an blend of an ethoxylated quaternary amine based surfactant containing approximately 60-95 weight percent of ethoxylated quaternary amines and approximately 5-40 weight percent alcohol ethoxylates.

While not wishing to be bound by the following it is believed that the combined cationic and nonionic surfactants present in the Berol 266 material and/or the Videt Q3 material provides excellent penetration of dried or baked on stains, especially baked on milk stains on glass cooktop surfaces, e.g., hobs. It is hypothesized that the combination of both the nonionic surfactant and the cationic surfactant present favorably contribute to the soil penetration behavior. Such soil penetration behavior appears to be particularly true where in the nonionic surfactant present in such a blend are ethoxylates of alcohols of about 9 to about 11 carbon atoms with about 3 to about 6 ethoxylates.

Thus in a further aspect the compositions of the invention include between 0.01-5% wt., preferably 0.5-2.5% wt., and more preferably 0.75-2.25% wt. of a surfactant constituent which is a blend of ethoxylated quaternary amine based surfactants with nonionic alcohol ethoxylate surfactants wherein the latter contain 9 to about 11 carbon atoms with about 3 to about 6 mols ethoxylation wherein in terms of weight ratio the ethoxylated quaternary amine based surfactants to the nonionic alcohol ethoxylated surfactants is at least 1:1, preferably at least 1.05:1, more preferably at least 1.1:1, still more preferably at least 1.2:1, and yet more preferably at least 1.3:1. Preferred weight ratios of the ethoxylated quaternary amine based surfactants to the nonionic alcohol ethoxylated surfactants are 1.05-5:1, preferably 1.1-4:1, yet more preferably 1.2-3.5:1 In the above preferred ratio related blends, the nonionic surfactant present in such a blend are ethoxylates of alcohols of about 9 to about 11 carbon atoms with about 3 to about 6 mols of ethoxylation of the nonionic surfactant present in such a blend are ethoxylates of alcohols of about 9 to about 11 carbon atoms with about 3 to about 6 mols ethoxylation.

The compositions of the invention thus necessarily include at least one nonionic surfactant which may be present with, or without an ethoxylated quaternary amine based surfactant although in especially preferred embodiments as discussed above such an ethoxylated quaternary amine based surfactant is desirably concurrently present particularly wherein the nonionic surfactant is a nonionic alcohol ethoxylate. The total amount of nonionic surfactant present in the inventive compositions are advantageously from 0.1-5% wt., but preferably are from 0.5-5% wt. and whether present independent of, or forming part of the blends of ethoxylated quaternary amine based surfactants with nonionic alcohol ethoxylate surfactants when present.

Notwithstanding the foregoing, according to certain preferred embodiments, cationic surfactants may be expressly excluded from the compositions of the present invention.

Exemplary amphoteric surfactants which are contemplated to be useful in the cosurfactant constituent include one or more water-soluble betaine surfactants which may be represented by the general formula:

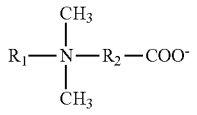

wherein $R_1$ is an alkyl group containing from 8 to 18 carbon atoms, or the amido radical which may be represented by the following general formula:

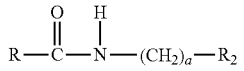

wherein R is an alkyl group having from 8 to 18 carbon atoms, a is an integer having a value of from 1 to 4 inclusive, and $R_2$ is a $C_1$-$C_4$ alkylene group. Examples of such water-soluble betaine surfactants include dodecyl dimethyl betaine, as well as cocoamidopropylbetaine.

According to certain preferred embodiments, amphoteric and zwitterionic surfactants are however expressly excluded from the compositions of the present invention.

When present, the total amount such further cosurfactants based on anionic, cationic, amphoteric or zwitterionic surfactants may be present in effective amounts, and advantageously such further surfactants comprise from 0.1-7% wt. preferably from 0.25-5% wt. of such further cosurfactants. Particularly preferred further surfactants, and amounts, are indicated with reference to one or more of the Examples.

According to certain particularly preferred embodiments the compositions of the invention exclude further surfactants based on cationic, amphoteric or zwitterionic surfactants. In still further embodiments the compositions of the invention necessarily exclude further surfactants based anionic, cationic, amphoteric or zwitterionic surfactants.

The compositions of the invention comprise an organic solvent constituent which may include one or more alcohols, glycols, acetates, ether acetates and glycol ethers. Exemplary alcohols include $C_3$-$C_8$ alcohols which may be straight chained or branched, and which are specifically intended to include both primary and secondary alcohols. Exemplary glycol ethers include those glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$-$C_{20}$ glycol ethers By way of further non-limiting example specific organic solvents useful in the inventive compositions include propylene glycol methyl ether, dipropylene glycol methyl ether, tripropylene glycol methyl ether, propylene glycol n-propyl ether, propylene glycol n-butyl ether, ethylene glycol n-butyl ether, diethylene glycol n-butyl ether, diethylene glycol methyl ether, dipropylene glycol n-propyl ether, propylene glycol, ethylene glycol, isopropanol, ethanol, methanol, diethylene glycol monoethyl ether acetate and particularly advantageously ethylene glycol hexyl ether, diethylene glycol hexyl ether, as well as the $C_3$-$C_8$ primary and secondary alcohols, especially isopropyl alcohol.

Particularly useful as constituent (d) include organic solvents as are presently commercially available under the tradenames CARBITOL® (Union Carbide Corp., Danbury Conn.), CELLOSOLVE® (Union Carbide Corp., Danbury Conn.), DOWANOL® (Dow Chemical Co., Midland Mich.) and ARCOSOLV® (ARCO Chemical Co., Newton Square Pa.). Particularly useful are those organic solvents which are illustrated in the Examples as well as: DOWANOL® PM, propylene glycol methyl ether; DOWANOL® DPnP, dipropylene glycol n-propyl ether; as well as DOWANOL® PnB, propylene glycol n-butyl ether.

In certain particularly preferred embodiments the sole organic solvents present in the inventive compositions are one or more glycol ethers, and especially one or more glycol ethers selected from the group consisting of: propylene glycol methyl ether, dipropylene glycol n-propyl ether, and, propylene glycol n-butyl ether. In further particularly preferred embodiments the sole organic solvents present in the inventive compositions are one or more of propylene glycol methyl ether, dipropylene glycol n-propyl ether, and, propylene glycol n-butyl ether, to the exclusion of other organic solvents. Particularly preferred organic solvents and systems of organic solvents are disclosed with reference to one or more of the Examples.

The organic solvent constituent may be present in any effective amount and advantageously the organic solvent constituent comprises from 0.01-5% wt., preferably from 0.1-5% wt., based on the total weight of the composition of which it forms a part.

The compositions of the invention necessarily comprise an acid constituent, which necessarily includes one or more acids which are present in a sufficient amount in order to impart an acid pH to the compositions. The acids useful in the acid constituent may be one or more water soluble inorganic acids, mineral acids, or water soluble organic acids, with virtually all such known materials contemplated as being useful in the present inventive compositions. Exemplary inorganic acids include, e.g., phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate and sulfamic acid. Alkyl sulfonic acids, e.g., methane sulfonic acid may also be used as a co-acid component of the acid system. Strong inorganic acids such as hydrochloric acid, nitric acid and sulfuric acid may also be used, however are less preferred due to their strong acidic character; if present are present in only minor amounts. However, the use of water soluble acids as are preferred, including water soluble salts of organic acids. Exemplary organic acids are those which generally include at least one carbon atom, and include at least one carboxyl group (—COOH) in its structure. Exemplary useful water soluble organic acids which contain from 1 to about 6 carbon atoms, and at least one carboxyl group as noted. Exemplary useful organic acids include: linear aliphatic acids such as acetic acid, citric acid, propionic acid, butyric acid and valeric acid; dicarboxylic acids such as malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, α-hydroxybutyric acid, glyceric acid, tartronic acid, malic acid, tartaric acid and citric acid, as well as acid salts of these organic acids. The use of water soluble acids are preferred, including water soluble salts of organic acids.

In certain particularly preferred embodiments the acid constituent comprises citric acid.

The acid constituent may be present in any amount effective in imparting an acidic pH to the inventive compositions. The acid constituent may be present in any effective amount, but desirably is not present in amounts totaling more than about 20% wt. based on the total weight of the compositions. It is to be understood that the nature of the acid or acids selected to form the acid constituent will influence the amount of acid required to obtain a desired final pH or pH range, and the precise amount of acid required for a specific composition can be readily obtained by a skilled artisan utilizing conventional techniques. Preferably the pH of the inventive compositions is between 0.001-3.5, more preferably is between 0.1-3, yet more preferably is between 0.5 and 2.75, and especially preferably, in order of increasing preference a pH of at least 0.5, 0.6, 0.7, 0.8, 0.9, 1, 1.1, 1.2, 1.3, 1.4, 1.5, 1.6, 1.7, 1.8, 1.9, 2.0 and 2.1. Concurrently the pH of the compositions is, in order of increasing preference not more than: 3.0, 2.9, 2.8, 2.7, 2.6, 2.5, 2.4, 2.3 and 2.2. Certain specific and preferred pHs are demonstrated with reference to one or more of the Examples described hereinafter.

The acid constituent may be present in any effective amount, but desirably is not present in amounts totaling more than about 20% wt. based on the total weight of the compositions. It is to be understood that the nature of the acid or acids selected to form the acid constituent will influence the amount of acid required to obtain a desired final pH or pH range, and the precise amount of acid required for a specific composition can be readily obtained by a skilled artisan utilizing conventional techniques. Further, the amount of acid present in the composition, keeping in mind any optional ingredients that may be present, should be in an amount such that the pH of the composition is about 3 or less, and especially within the preferred pH ranges indicated previously. Generally however, the inclusion of the acid constituent in an amount of from about 0.1 to 10% wt., more preferably from about 1 to 5% wt. has yielded good results. Particularly preferred acids for use in the acid constituent and particularly preferred amounts thereof are also described with reference to one or more of the Examples.

The compositions of the invention may optionally include one or more further constituents including coloring agents, fragrances and fragrance solubilizers, viscosity modifying agents including one or more thickeners, pH adjusting agents and pH buffers including organic and inorganic salts, optical brighteners, organic solvents, opacifying agents, hydrotropes, abrasives, and preservatives, as well as other optional constituents known to the art. When present the total amount of such further constituent is less not more than about 15% wt, preferably not more than about 10% wt., based on the total weigh of the composition of which it forms a part.

By way of non-limiting example pH adjusting agents include phosphorus containing compounds, monovalent and polyvalent salts such as of silicates, carbonates, and borates, certain acids and bases, tartrates and certain acetates. Further exemplary pH adjusting agents include mineral acids, basic compositions, and organic acids, which are typically required in only minor amounts. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, and their alkali metal salts. When present, the pH adjusting agent, especially the pH buffers are present in an amount effective in order to maintain the pH of the inventive composition within a target pH range.

The inventive compositions may include one or more coloring agents which may be included to impart a desired color or tint to the compositions.

The compositions of the invention optionally but in certain cases desirably include a fragrance constituent. Fragrance raw materials may be divided into three main groups: (1) the essential oils and products isolated from these oils; (2) products of animal origin; and (3) synthetic chemicals.

The essential oils consist of complex mixtures of volatile liquid and solid chemicals found in various parts of plants. Mention may be made of oils found in flowers, e.g., jasmine, rose, mimosa, and orange blossom; flowers and leaves, e.g., lavender and rosemary; leaves and stems, e.g., geranium, patchouli, and petitgrain; barks, e.g., cinnamon; woods, e.g., sandalwood and rosewood; roots, e.g., angelica; rhizomes, e.g., ginger; fruits, e.g., orange, lemon, and bergamot; seeds, e.g., aniseed and nutmeg; and resinous exudations, e.g., myrrh. These essential oils consist of a complex mixture of chemicals, the major portion thereof being terpenes, including hydrocarbons of the formula (C5H8)n and their oxygenated derivatives. Hydrocarbons such as these give rise to a large number of oxygenated derivatives, e.g., alcohols and their esters, aldehydes and ketones. Some of the more important of these are geraniol, citronellol and terpineol, citral and citronellal, and camphor. Other constituents include aliphatic aldehydes and also aromatic compounds including phenols such as eugenol. In some instances, specific compounds may be isolated from the essential oils, usually by distillation in a commercially pure state, for example, geraniol and citronellal from citronella oil; citral from lemon-grass oil; eugenol from clove oil; linalool from rosewood oil; and safrole from sassafras oil. The natural isolates may also be chemically modified as in the case of citronellal to hydroxy citronellal, citral to ionone, eugenol to vanillin, linalool to linalyl acetate, and safrol to heliotropin.

Animal products used in perfumes include musk, ambergris, civet and castoreum, and are generally provided as alcoholic tinctures.

The synthetic chemicals include not only the synthetically made, also naturally occurring isolates mentioned above, but also include their derivatives and compounds unknown in nature, e.g., isoamylsalicylate, amylcinnamic aldehyde, cyclamen aldehyde, heliotropin, ionone, phenylethyl alcohol, terpineol, undecalactone, and gamma nonyl lactone.

Fragrance compositions as received from a supplier may be provided as an aqueous or organically solvated composition, and may include as a hydrotrope or emulsifier a surface-active agent, typically a surfactant, in minor amount. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

One or more coloring agents may also be used in the inventive compositions in order to impart a desired colored appearance or colored tint to the compositions. Known art water soluble or water dispersible pigments and dyes may be added in effective amounts.

The inventive compositions may include a hydrotrope constituent comprising one or more compounds which exhibit a hydrotropic functionality in the inventive compositions. Exemplary hydrotropes include, inter alia, benzene sulfonates, naphthalene sulfonates, $C_1$-$C_{11}$ alkyl benzene sulfonates, naphthalene sulfonates, $C_5$-$C_{11}$ alkyl sulfonates, $C_6$-$C_{11}$ alkyl sulfates, alkyl diphenyloxide disulfonates, and phosphate ester hydrotropes. The hydrotropic compounds of the invention are often provided in a salt form with a suitable counterion, such as one or more alkali, or alkali earth metals, such as sodium or potassium, especially sodium. However, other water soluble cations such as ammonium, mono-, di- and tri-lower alkyl, i.e., $C_{1-4}$ alkanol ammonium groups can be used in the place of the alkali metal cations. Exemplary alkyl benzene sulfonates include, for example, isopropylbenzene sulfonates, xylene sulfonates, toluene sulfonates, cumene sulfonates, as well as mixtures thereof. Exemplary $C_5$-$C_{11}$ alkyl sulfonates include hexyl sulfonates, octyl sulfonates, and hexyl/octyl sulfonates, and mixtures thereof. Particularly useful hydrotrope compounds include benzene sulfonates, o-toluene sulfonates, m-toluene sulfonates, and p-toluene sulfonates; 2,3-xylene sulfonates, 2,4-xylene sulfonates, and 4,6-xylene sulfonates; cumene sulfonates, wherein such exemplary hydrotropes are generally in a salt form thereof, including sodium and potassium salt forms. When present the hydrotrope constituent may be present in any effective amounts, or they may be omitted. Advantageously, when present, the hydrotrope constituent comprises 0.001-1% wt. of the composition of which it forms a part.

A further optional constituent are one or more preservatives. Such preservatives are primarily included to reduce the growth of undesired microorganisms within the composition during storage prior to use. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. Further exemplary useful preservatives include those which are commercially including a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful and commercially available preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.).

Optionally the compositions of the invention may include a thickener constituent, which may be added in any effective amount in order to increase the viscosity of the compositions. Exemplary thickeners useful in the thickener constituent include one or more of polysaccharide polymers selected from cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, naturally occurring polysaccharide polymers such as xanthan gum, guar gum, locust bean gum, tragacanth gum, or derivatives thereof, polycarboxylate polymers, polyacrylamides, clays, and mixtures thereof.

In certain particularly preferred embodiments, the compositions of the invention exclude the foregoing thickener constituent.

Optionally the compositions of the invention may include a polymer constituent. By way of non-limiting examples, such film forming polymers include film-forming polymers or other film-forming materials selected from:

a polymer having the formula

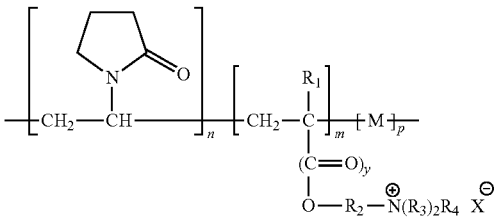

in which n represents from 20 to 99 and preferably from 40 to 90 mol %, m represents from 1 to 80 and preferably from 5 to 40 mol %; p represents 0 to 50 mol, (n+m+p=100); $R_1$ represents H or $CH_3$; y represents 0 or 1; $R_2$ represents —$CH_2$—CHOH—$CH_2$— or $C_xH_{2x}$ in which x is 2 to 18; $R_3$ represents $CH_3$, $C_2H_5$ or t-butyl; $R_4$ represents $CH_3$, $C_2H_5$ or benzyl; X represents Cl, Br, I, ½$SO_4$, $HSO_4$ and $CH_3SO_3$; and M is a vinyl or vinylidene monomer copolymerisable with vinyl pyrrolidone other than the monomer identified in $[\ ]_m$;

water soluble polyethylene oxide;

polyvinylpyrrolidone;

high molecular weight polyethylene glycol;

polyvinylcaprolactam;

vinylpyrrolidone/vinyl acetate copolymer;

vinylpyrrolidone/vinyl caprolactam/ammonium derivative terpolymer, especially where the ammonium derivative monomer has 6 to 12 carbon atoms and is selected from diallylamino alkyl methacrylamides, dialkyl dialkenyl ammonium halides, and a dialkylamino alkyl methacrylate or acrylate;

polyvinylalcohol;

cationic cellulose polymer;

film-forming fatty quaternary ammonium compounds;

organosilicone quaternary ammonium polymers;

polyamide polymers;

one or more of which may be present in effective amounts.

As is noted above, the hard surface cleaning compositions according to the invention are largely aqueous in nature. Water is added to order to provide to 100% by weight of the compositions of the invention, and desirably comprises at least 70% water, and in order of increasing preference contains 70, 71, 72, 73, 74, 75, 76, 77, 78, 79, 80, 81, 82, 83, 84, 85, 86, 87, 88, 89, 90, 91, and 92 percent water. Concurrently the compositions of the invention comprise, in order of increasing preference, not more than 88, 89, 90. 91. 92, 93, 94, 95, 96, 97, 98 and 99 percent water. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the compositions according to the invention.

Surprisingly the compositions of the invention are very effective in the cleaning treatment of hobs and glass cooktop surfaces in the absence of abrasives. Exemplary abrasives include: oxides, e.g., calcined aluminum oxides and the like, carbonates, e.g., calcium carbonate and the like, quartzes, siliceous chalk, diatomaceous earth, colloidal silicon dioxide, alkali metasilicates, e.g., sodium metasilicate and the like, perlite, pumice, feldspar, calcium phosphate, organic abrasive materials based on comminuted or particulate polymers especially one or more of polyolefins, polyethylenes, polypropylenes, polyesters, polystyrenes, acetonitrile-butadiene-styrene resins, melamines, polycarbonates, phenolic resins, epoxies and polyurethanes, natural materials such as, for example, rice hulls, corn cobs, ground nutshells, hardwood sawdust and the like, or talc and mixtures thereof. The particle size such abrasives are typically in the range of from about 1 μm to about 1000 μm, more usually from between about 10 μm to about 200 μm. The foregoing listing of abrasive materials are to be understood as being illustrative but not limiting in scope, thereof. Desirably, the compositions of the invention exclude water insoluble, particulate abrasive materials including one or more of the foregoing recited abrasive materials.

The compositions according to the invention are desirably provided as a ready to use product which may be directly applied to a hard surface particularly and preferably hobs and glass cooktops as found on cooking stoves in environments associated with food preparation.

The inventive compositions may be packaged in any suitable container particularly flasks or bottles, including squeeze-type bottles, as well as bottles provided with a spray apparatus which is used to dispense the composition by spraying. The inventive compositions are readily pourable and readily pumpable cleaning compositions which features the benefits described above. Accordingly the inventive compositions are desirably provided as a ready to use product in a manually operated spray dispensing container, or may be supplied in aerosolized product wherein it is discharged from a pressurized aerosol container. Propellants which may be used are well known and conventional in the art and include, for example, a hydrocarbon, of from 1 to 10 carbon atoms, such as n-propane, n-butane, isobutane, n-pentane, isopentane, and mixtures thereof; dimethyl ether and blends thereof as well as individual or mixtures of chloro-, chlorofluoro- and/or fluorohydrocarbons- and/or hydrochlorofluorocarbons (HCFCs). Useful commercially available compositions include A-70 (Aerosol compositions with a vapor pressure of 70 psig available from companies such as Diversified and Aeropress) and Dymel® 152a (1,1-difluoroethane from DuPont). Compressed gases such as carbon dioxide, compressed air, nitrogen, and possibly dense or supercritical fluids may also be used. In such an application, the composition is dispensed by activating the release nozzle of said aerosol type container onto the area in need of treatment, and in accordance with a manner as above-described the area is treated (e.g., cleaned and/or sanitized and/or disinfected). If a propellant is used, it will generally be in an amount of from about 1% to about 50% of the aerosol formulation with preferred amounts being from about 2% to about 25%, more preferably from about 5% to about 15%. Generally speaking, the amount of a particular propellant employed should provide an internal pressure of from about 20 to about 150 psig at 70° F.

In a second aspect of the invention there is provided a method for cleaning hard surfaces comprising the step of providing a cleaning effective amount of a hard surface cleaning composition as described herein to a surface in need of cleaning, particularly hobs and glass cooktops as found on cooking stoves in environments associated with food preparation where stains are present. The compositions are particularly useful in the cleaning treatment of food stains, especially dried or baked on food stains and in particular milk stains especially dried or burnt on milk stains from hobs and glass cooktops.

The compositions according to the invention can also be suited for use in a consumer "spray and wipe" application as a cleaning composition. In such an application, the consumer generally applies an effective amount of the composition using the pump and within a brief time period thereafter, e.g. 5 seconds to 5 minutes, wipes off the treated area with a rag, towel, or sponge, usually a disposable paper towel or sponge. In certain applications, however, especially where undesirable stain deposits are heavy, the cleaning composition according to the invention may be left on the stained area, e.g. hobs and glass cooktops as found on cooking stoves in environments associated with food preparation, until it has effectively loosened the stain deposits after which it may then be wiped off, rinsed off, or otherwise removed. For particularly heavy deposits of such undesired stains, multiple applications may also be used. Optionally, after the composition has remained on the surface for a period of time, it could be rinsed or wiped from the surface.

According to a further aspect of the invention, there is provided a method for the manufacture of said compositions as described herein.

Certain embodiments of the invention, including certain particularly preferred embodiments of the invention are disclosed in the following examples.

EXAMPLES

A number of formulations were produced by mixing the constituents outlined in Table 1 by adding the individual constituents into a beaker of deionized water at room temperature which was stirred with a conventional magnetic stirring rod. Stirring continued until the formulation was homogenous in appearance. It is to be noted that the constituents might be added in any order, but it is preferred that a first premixture is made of any fragrance constituent with one or more surfactants used in the inventive compositions. Thereafter, a major amount of water is first provided to a suitable mixing vessel or apparatus as it is the major constituent and thereafter the further constituents are added thereto convenient. The order of addition is not critical, but good results are obtained where the surfactants (which may be also the premixture of the fragrance and surfactants) are added to the water prior to the remaining constituents.

The exact compositions of the example formulations are listed on Table 1, below, and are identified by one or more digits preceded by the letter "E". Certain comparative compositions are also disclosed on Table 1, and are identified by one or more digits preceded by the letter "C".

TABLE 1

| | C1 | E1 | E2 | E3 | E4 | E5 | E6 | E7 | E8 | E9 | E10 |
|---|---|---|---|---|---|---|---|---|---|---|---|
| Neodol 91-8 | 2.0 | — | — | — | — | 2.0 | 2.0 | 2.0 | — | 3.79 | 1.9 |
| Dowanol PnB | 1.0 | 2.0 | — | — | 2.0 | — | — | — | — | 3.79 | 1.9 |
| Dowanol PM | 0.5 | 0.47 | 0.47 | 0.47 | 0.47 | 0.47 | 0.47 | 0.49 | 0.49 | 0.47 | 0.47 |
| Dowanol DPnP | — | — | — | 2.0 | 2.0 | 2.0 | — | — | 2.0 | — | — |
| citric acid, anhydrous | 2.18 | 2.09 | 2.15 | 2.09 | 2.07 | 2.07 | 2.04 | 2.13 | 2.13 | 2.06 | 2.07 |
| fragrance | 0.4 | 0.38 | 0.39 | 0.38 | 0.38 | 0.38 | 0.37 | 0.39 | 0.39 | 0.37 | 0.38 |
| polymer | 0.4 | 0.38 | 0.39 | 0.38 | 0.38 | 0.38 | 0.37 | 0.39 | 0.39 | 0.37 | 0.38 |
| Berol ENV 226 | — | 1.0 | 1.0 | 1.0 | 1.0 | 1.0 | — | — | — | — | 0.95 |
| Videt Q3 (90%) | — | 1.1 | — | 1.1 | — | — | — | — | — | — | |
| d.i. water | q.s. | q.s. | q.s. | q.s. | q.s. | q.s. | q.s. | q.s. | q.s. | q.s. | q.s. |

| | E11 | E12 | E13 | E14 | E15 | E16 | E17 | E18 |
|---|---|---|---|---|---|---|---|---|
| Neodol 91-8 | — | — | 2.0 | 2.0 | — | 2.0 | 2.0 | 0.5 |
| Dowanol PnB | 2.0 | 2.0 | — | — | — | 2.0 | 2.0 | — |
| Dowanol PM | 0.48 | 0.49 | 0.47 | 0.47 | 0.49 | 0.48 | 0.47 | 0.5 |

TABLE 1-continued

| | | | | | | | | |
|---|---|---|---|---|---|---|---|---|
| Dowanol DPnP | 2.0 | — | — | 2.0 | — | 2.0 | 2.0 | 0.6 |
| citric acid, anhydrous | 2.09 | 2.13 | 2.09 | 2.06 | 2.15 | 2.11 | 2.04 | 2.18 |
| fragrance | 0.38 | 0.39 | 0.38 | 0.37 | 0.39 | 0.38 | 0.37 | 0.4 |
| polymer | 0.38 | 0.39 | 0.38 | 0.37 | 0.39 | 0.38 | 0.37 | 0.4 |
| Berol ENV 226 | — | — | 1.0 | — | — | 1.0 | 1.0 | 1.0 |
| Videt Q3 (90%) | — | — | 1.1 | 1.1 | 1.1 | 1.0 | 1.0 | — |
| d.i. water | q.s. | q.s. | q.s. | q.s. | q.s. | q.s. | q.s. | q.s. |

All of the formulations on the foregoing Table 1 are indicated in weight percent, and each composition comprised 100% wt. Each of the foregoing compositions on Table 1 exhibited a pH of 2.1-2.4.

The individual constituents were used, "as-supplied" from their respective source and unless otherwise indicated, each of the constituents are to be understood as being "100% wt. actives". Deionized water was added in quantum sufficient, "q.s.", to provide the balance to 100% wt. of each of the example compositions. The sources of the constituents used in the formulations of Tables 1 are described on the following Table 2.

TABLE 2

| | |
|---|---|
| Neodol 91-8 | nonionic surfactant, $C_9$-$C_{11}$ alcohol ethoxylate, 8 moles of ethoxylation, averaged (100% wt. actives) |
| Dowanol PnB | dipropylene glycol n-butyl ether (98-100% wt. actives) |
| Dowanol PM | propylene glycol methyl ether (98-100% wt. actives) |
| Dowanol DPnP | dipropylene glycol n-propyl ether (98-100% wt. actives) |
| citric acid, anhydrous | anhydrous citric acid, laboratory grade (99.5-100% wt. actives) |
| fragrance | proprietary composition of its supplier |
| polymer | film forming polymer, proprietary composition of its supplier |
| Berol ENV 226 | a surfactant blend described by its supplier to be: 10-24% wt. of a quaternary coco alkyl methyl amine ethoxylate, metal chloride salt; 30-50% wt. $C_9$-$C_{11}$ alcohol ethoxylate; 30-50% wt. water (ex. Akzo Nobel AB) |
| Videt Q3 (90%) | A blended composition described by its supplier to be: 5% wt. surfactant, 1.6% wt. EDTA, 4% wt. sodium gluconate, balance to 100% wt. water (ex. Vitech International Inc.) |
| d.i. water | deionized water |

Several of the foregoing compositions were tested and evaluated according to the following test protocol, which evaluated the efficacy of the removal of baked on milk stains and dried on tomato sauce stains from sample glass cooktop plates.

Food Stain Removal (I):

Compositions according to the invention as described on Table 1 were evaluated to assess their cleaning efficacy in the cleaning treatment of baked on a milk stains on sample glass cooktop surface materials.

For the test, a series of 4 inch by 4 inch tiles made of glass cooktop material (ex. Schott Glasswerke, Germany) were used as a substrate to test the cleaning efficacy of baked on (burnt on) milk stains. The preparation of the tile substrates was as follows. Onto a surface of a new tile was applied from a pipette or eyedropper a 5 g sample of whole milk at approximately the center of the tile, which was thereafter spread over the surface of the top using a 3 mm 'Doctor' blade which was used to provide a generally uniform thickness film across a major portion of the tile surface. Thereafter, the tile having the milk was allowed to dry overnight. The next morning, each tile was then baked for 15 minutes at 200° C. in a laboratory oven in order to ensure that the milk stain was properly hardened. They thereafter, the tile was removed, and allow to dry at room temperature (approx. 20° C.) until it was cool and reached at room temperature.

For the test, a series of 4 inch by 4 inch tiles made of glass cooktop material (ex. Schott Glasswerke, Germany) were used as a substrate to test the cleaning efficacy of baked on tomato sauce stains. The preparation of the tile substrates was as follows. Onto a surface of a new tile was applied a 5 g sample of a commercially available tomato sauce (Hunt's Tomato Sauce) at approximately the center of the tile, which was thereafter spread over the surface of the top using a brush in order to distribute the sauce to form a generally uniform thickness film across a major portion of the tile surface. Thereafter, the tile having the tomato sauce applied thereon was allowed to dry overnight, and the next day each tile was then baked for 15 minutes at 200° C. in a laboratory oven in order to ensure that the milk stain was properly hardened. They thereafter, the tile was removed, and allow to dry at room temperature (approx. 20° C.) until it was cool and reached at room temperature.

Aliquots of sample compositions as described in Table 1 were then applied to the surface as separate files prepared as described above. For each tested composition, 10 mL of a test composition was applied using a pipette or an eyedropper, onto the surface of a cellulose sponge which had been previously rinsed and dried in an automatic dishwasher, and which was also subsequently rinsed in tap water, and thoroughly manually wrung to remove the dishwashing liquor therefrom. The thus prepared sponge was then inserted into the holder of a Sheen Abrasion Tester with these surface of the sponge onto which the test composition had been applied facing downward. A test tile substrate bearing a baked on milk stain was inserted onto the platform of the aforesaid device, after which a 400 g weight was placed above the holder of the sponge, thereby urging the surface of the sponge against the surface of the tile substrate. The device was operated to provide 36 wipes or "passes" of the treated sponge across the surface, after which the device was stopped, and the treated tile substrate was removed, and allowed to air dry.

All of the thus treated tiles in the test were then assembled into an array upon a flat surface, such as a laboratory bench top. Additionally, for each type of stain a pair of "reference tiles" which were identified as having a degree of cleanliness of 100%, and a 0% were used as reference tiles for comparative purposes for evaluating the degree of cleaning of each of the treated tile substrates, for each of the types of stains, viz. mile or tomato sauce. Evaluation of the test composition's efficacy in the cleaning of the treated tiles of stains was performed by visual observation by 20 human panelists who gauged to the cleaning performance as compared to the two reference tiles. The rating or ranking as assigned by the individual human panelists were then averaged for each of the test composition and evaluated. Typically, multiple replicates, here six replicates of each test composition use to clean a tile substrate were performed as part of the cast in order to improve the statistical accuracy of the results. The cleaning efficacy results are provided on the following Table 3:

TABLE 3

| | % removal - milk stain | % removal - tomato stain |
|---|---|---|
| E1 | 85 | 100 |
| E2 | 80 | 100 |
| E3 | 90 | 95 |
| E4 | 90 | 100 |
| E5 | 90 | 95 |
| E6 | 90 | 95 |
| E7 | 90 | 90 |
| E8 | 65 | 85 |
| E9 | 80 | 95 |
| E10 | 70 | 90 |
| E11 | 20 | 50 |
| E12 | 15 | 45 |
| E13 | 45 | 100 |
| E14 | 30 | 65 |
| E15 | 20 | 70 |
| E16 | 20 | 70 |
| E17 | 55 | 90 |

As can be seen from the foregoing, compositions of the invention according to one or more of the examples provided excellent removal of the test stains, particularly baked on milk stains.

Food Stain Removal (II):

Compositions according to the invention as described on Table 1 were evaluated in a further separate to assess their cleaning efficacy in the cleaning treatment of baked on a milk stains on sample glass cooktop surface materials. Samples of a comparative composition as described on Table 1 were also tested in this manner as well.

The preparation of the test substrates and evaluation of cleaning for each tested composition was performed as described above with reference to "Food Stain Removal (I)", except in this test the comparative composition identified as C1 on Table 1, was compared for cleaning performance against the composition E18, and again, 6 replicates were prepared and tested for each tested composition. In this test, only burnt on milk was the tested stain. The results of the evaluation are reported on Table 4.

TABLE 4

| | % removal - milk stain |
|---|---|
| C1 | 3 |
| E18 | 32 |

As can be seen from the foregoing, the composition of E18 according to the invention was far superior in cleaning efficacy of the burnt on milk stain as compared to the composition of the comparative example, C1.

Food Stain Removal (II):

Compositions according to the invention as described on Table 1 were evaluated in a further separate to assess their cleaning efficacy in the cleaning treatment of baked on a milk stains on sample glass cooktop surface materials. Samples of a comparative composition as described on Table 1 were also tested in this manner as well.

The preparation of the test substrates and evaluation of cleaning for each tested composition was performed as described above with reference to "Food Stain Removal (I)", except in this test the comparative composition identified as C1 on Table 1, was compared for cleaning performance against the composition E18, but in this test 3 replicates were prepared and tested for each tested composition. In this test, both burnt on milk and baked on tomato sauce stains were tested. The results of the evaluation are reported on Table 5.

TABLE 5

| | % removal - milk stain | % removal - tomato stain |
|---|---|---|
| C1 | 42 | 62 |
| E18 | 69 | 56 |

As can be seen from the foregoing, the composition of E18 according to the invention was far superior in cleaning efficacy of the burnt on milk stain as compared to the composition of the comparative example, C1.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

The invention claimed is:

1. An aqueous acidic aqueous hob cleaning composition having a pH of from 0.001-3.5 free of water insoluble, particulate abrasive materials comprising:

0.01-5% wt. of a surfactant blend comprising ethoxylated quaternary amine based surfactants with nonionic alcohol ethoxylate surfactants having 9 to 11 carbon atoms and 3 to 6 mols ethoxylation, wherein the weight ratio of the ethoxylated quaternary amine based surfactants to the nonionic alcohol ethoxylate surfactants is at least 1:1;

0.01-5% wt. of an organic solvent constituent comprising one or more glycol ethers selected from the group consisting of: propylene glycol methyl ether, dipropylene glycol n-propyl ether, and, propylene glycol n-butyl ether;

optionally up to 7% wt. of at least one cosurfactant selected from anionic, cationic, amphoteric and zwitterionic surfactants.

2. An aqueous acidic aqueous hob cleaning composition according to claim 1 wherein the surfactant blend comprising ethoxylated quaternary amine based surfactants with nonionic alcohol ethoxylate surfactants having 9 to 11 carbon atoms and 3 to 6 mols ethoxylation is an aqueous surfactant blend which includes 10-24% wt. of a metal chloride salt of a quaternary coco alkyl methyl amine ethoxylate; 30-50% wt. $C_9$-$C_{11}$ ethoxylated alcohol, avg. 4-5.5 degree of ethoxylation; and, 30-50% wt. water.

3. An aqueous acidic aqueous hob cleaning composition according to claim 1 wherein the surfactant blend comprising ethoxylated quaternary amine based surfactants with nonionic alcohol ethoxylate surfactants having 9 to 11 carbon atoms and 3 to 6 mols ethoxylation is a blend of an ethoxylated quaternary amine based surfactant containing approximately 60-95 weight percent of ethoxylated quaternary amines and approximately 5-40 weight percent alcohol ethoxylates.

4. An aqueous acidic aqueous hob cleaning composition according to claim 1 wherein the organic solvent constituent comprising one or more glycol ethers selected from the group consisting of:

propylene glycol methyl ether, dipropylene glycol n-propyl ether, and, propylene glycol n-butyl ether expressly excludes further organic solvents.

5. An aqueous acidic aqueous hob cleaning composition according to claim 1 wherein composition further comprises 0.01-10% wt. of an organic acid.

6. An aqueous acidic aqueous hob cleaning composition according to claim 1 wherein composition further comprises 0.01-10% wt. of citric acid.

7. A method of cleaning milk stains from glass cooktops comprising the step of:

providing a cleaning effective amount of a hard surface cleaning composition according to claim 1 to a burnt milk stain present on a hob or glass cooktop, and, removing the burnt milk stain.

8. An aqueous acidic aqueous hob cleaning composition having a pH of from 0.001-3.5 free of water insoluble, particulate abrasive materials consisting essentially of:

0.01-5% wt. of a surfactant blend comprising ethoxylated quaternary amine based surfactants with nonionic alcohol ethoxylate surfactants having 9 to 11 carbon atoms and 3 to 6 mols ethoxylation, wherein the weight ratio of the ethoxylated quaternary amine based surfactants to the nonionic alcohol ethoxylate surfactants is at least 1:1 wherein the said surfactant blend is either (a) or (b) wherein:

(a) a surfactant blend which includes a metal chloride salt of a quaternary coco alkyl methyl amine ethoxylate with a $C_9$-$C_{11}$ ethoxylated alcohol having an avg. 4-5.5 degree of ethoxylation, and, (b) a surfactant blend of an ethoxylated quaternary amine based surfactant containing approximately 60-95% wt. ethoxylated quaternary amines and approximately 5-40% wt. alcohol ethoxylates;

0.01-5% wt. of an organic solvent constituent comprising one or more glycol ethers selected from the group consisting of: propylene glycol methyl ether, dipropylene glycol n-propyl ether, and, propylene glycol n-butyl ether;

0.01-10% wt. of an organic acid;

optionally up to 7% wt. of at least one cosurfactant selected from anionic, cationic, amphoteric and zwitterionic surfactants, characterized in that the said composition is particularly effective in the removal of burnt milk stains from a hob or glass cooktop.

9. An aqueous acidic aqueous hob cleaning composition according to claim 8, wherein the organic acid is citric acid.

* * * * *